US012544817B2

(12) United States Patent
Speziali

(10) Patent No.: US 12,544,817 B2
(45) Date of Patent: Feb. 10, 2026

(54) WORKPIECE MANIPULATION DEVICE FOR A SWIVEL BENDING MACHINE

(71) Applicant: TRUMPF Maschinen Austria GmbH & Co. KG., Pasching (AT)

(72) Inventor: Stefano Speziali, Foligno (IT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 495 days.

(21) Appl. No.: 18/034,109

(22) PCT Filed: Nov. 15, 2021

(86) PCT No.: PCT/AT2021/060432

§ 371 (c)(1),
(2) Date: Apr. 27, 2023

(87) PCT Pub. No.: WO2022/099345

PCT Pub. Date: May 19, 2022

(65) Prior Publication Data

US 2023/0398592 A1 Dec. 14, 2023

(30) Foreign Application Priority Data

Nov. 16, 2020 (AT) ..... A50994/2020

(51) Int. Cl.
*B21D 5/04* (2006.01)
*B21D 43/10* (2006.01)
*B21D 43/11* (2006.01)

(52) U.S. Cl.
CPC ..... *B21D 5/042* (2013.01); *B21D 43/105* (2013.01); *B21D 43/11* (2013.01)

(58) Field of Classification Search
CPC ..... B21D 5/042; B21D 5/04; B21D 5/045; B21D 43/105; B21D 43/11
See application file for complete search history.

(56) References Cited

U.S. PATENT DOCUMENTS 2,480,190 A * 8/1949 Laxo ..... B21D 51/28 413/77
2,669,277 A * 2/1954 Williams ..... B21D 1/08 72/111

(Continued)

FOREIGN PATENT DOCUMENTS

CN 206951843 U 2/2018
DE 28 39 978 A1 3/1979

(Continued)

OTHER PUBLICATIONS

International Search Report in PCT/AT2021/060432, mailed Feb. 25, 2022.

*Primary Examiner* — Teresa M Ekiert
(74) *Attorney, Agent, or Firm* — Collard & Roe, P.C.

(57) ABSTRACT

A workpiece manipulation device for a swivel bending machine includes a base rack; a manipulation device carrier arranged on the base rack so as to be displaceable by a manipulation device carrier guide in a Y-axis relative to the base rack; a manipulation arm arranged on the manipulation device carrier so as to be displaceable by a manipulation arm guide in a Z-axis relative to the manipulation device carrier; a first rotary punch arranged on the manipulation arm, and a second rotary punch arranged on the manipulation device carrier. The manipulation device carrier is configured in an L-shape and has a first limb, which extends along a Y-axis, and a second limb, which extends along the Z-axis. The manipulation arm guide is formed on the second limb, and a distance between the manipulation arm guide and the rotational axis of the first rotary punch is greater than 1000 mm.

14 Claims, 3 Drawing Sheets

(56) References Cited

U.S. PATENT DOCUMENTS

Figure 1:
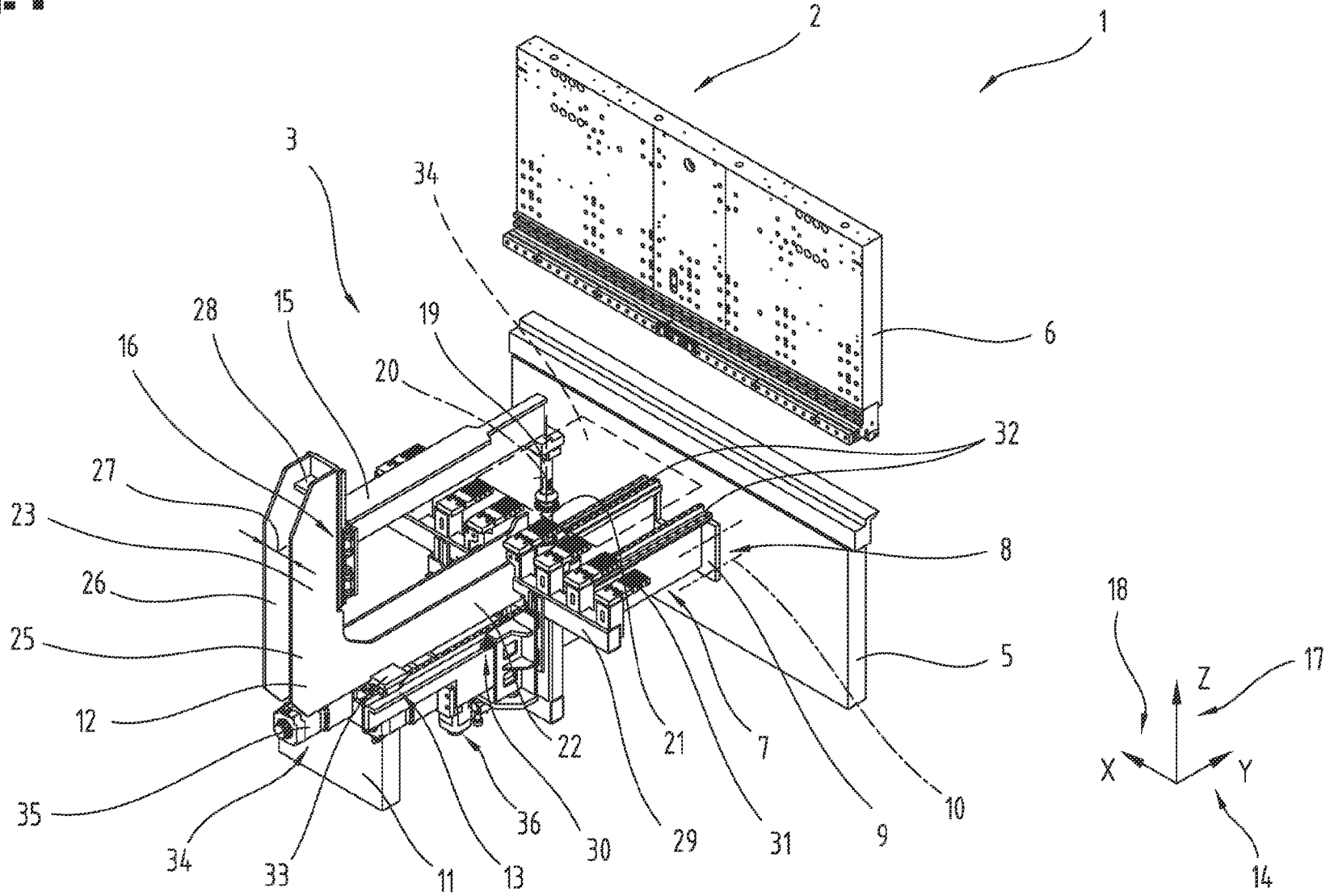

| | | | | |
|---|---|---|---|---|
| 4,242,898 | A | 1/1981 | Salvagnini | |
| 6,185,974 | B1 | 2/2001 | Venturini | |
| 8,555,690 | B2 | 10/2013 | Codatto | |
| 11,491,524 | B2 | 11/2022 | Dal Cerro et al. | |
| 2013/0236277 | A1* | 9/2013 | Bytow ..... | B21D 43/11 414/222.08 |
| 2020/0188979 | A1 | 6/2020 | Dal Cerro et al. | |

FOREIGN PATENT DOCUMENTS

| | | | |
|---|---|---|---|
| EP | 1 967 300 | A2 | 9/2008 |
| JP | H06-528 | U | 1/1994 |
| JP | H079355 | A | 1/1995 |
| JP | H11-342425 | A | 12/1999 |
| JP | 2001-269736 | A | 10/2001 |
| JP | 3794645 | B2 | 7/2006 |
| JP | 2019171392 | A | 10/2019 |
| WO | 2007/125900 | A1 | 11/2007 |
| WO | 2018/071938 | A1 | 4/2018 |

* cited by examiner

WORKPIECE MANIPULATION DEVICE FOR A SWIVEL BENDING MACHINE

CROSS REFERENCE TO RELATED APPLICATIONS

This application is the National Stage of PCT/AT2021/060432 filed on Nov. 15, 2021, which claims priority under 35 U.S.C. § 119 of Austrian Application No. A50994/2020 filed on Nov. 16, 2020, the disclosure of which is incorporated by reference. The international application under PCT article 21 (2) was not published in English.

The invention relates to a workpiece manipulation device as well as a processing system equipped with the workpiece manipulation device.

Various swivel bending machines as well as workpiece manipulation devices for feeding a workpiece to the swivel bending machine are known from the prior art.

The swivel bending machines known from the prior art have the disadvantage that the positioning of the workpiece can only be performed in an insufficient manner.

The object of the present invention was to overcome the shortcomings of the prior art and to provide a device, by means of which the workpiece can be positioned with an increased accuracy.

This object is achieved by means of a device and a method according to the claims.

The invention relates to a workpiece manipulation device for a swivel bending machine, wherein the workpiece manipulation device comprises:

- a base rack;
- a manipulation device carrier, which is arranged on the base rack so as to be displaceable by a manipulation device carrier guide in a Y-axis relative to said base rack;
- a manipulation arm, which is arranged on the manipulation device carrier so as to be displaceable by a manipulation arm guide in a Z-axis relative to the manipulation device carrier;
- a first rotary punch, which is arranged on the manipulation arm, wherein the first rotary punch is rotatable about a rotational axis that is parallel to the Z-axis;
- a second rotary punch, which is arranged on the manipulation device carrier, wherein the second rotary punch is rotatable about the rotational axis, wherein the first rotary punch and the second rotary stamp are arranged relative to one another such that a workpiece can be clamped between the first rotary punch and the second rotary punch, wherein the manipulation device carrier is configured in an L-shape and has a first limb, which extends along a Y-axis, and a second limb, which extends along the Z-axis, wherein the manipulation arm guide is formed on the second limb, and wherein a distance between the manipulation arm guide and the rotational axis of the first rotary punch is greater than 1000 mm.

The workpiece manipulation device according to the invention has the advantage that while the construction of the workpiece manipulation device is simple, a high degree of positioning accuracy of the workpiece can be achieved.

Furthermore, it can be useful if the distance between the manipulation arm guide and the rotational axis of the first rotary punch is between 130% and 70%, in particular between 120% and 80%, preferably between 110% and 90%, of a length of the first limb. Such a size ratio, in particular, entails the surprising advantage that an exceedingly high degree of positioning accuracy of the workpiece manipulation device can be achieved.

Furthermore, it can be provided that the distance between the manipulation arm guide and the rotational axis of the first rotary punch is between 1000 mm and 3000 mm, in particular between 1100 mm and 2500 mm, preferably between 1300 mm and 2000 mm Such a size ratio, in particular, entails the surprising advantage that an exceedingly high degree of positioning accuracy of the workpiece manipulation device can be achieved.

Moreover, it can be provided that the manipulation device carrier has a first cheek and a second cheek, which has an L-shaped configuration, wherein the first cheek and the second cheek are arranged at a distance from one another and are coupled to one another by means of webs. Particularly, such an embodiment of the manipulation device carrier has a high degree of torsional rigidity at the lowest possible weight, in order to thus achieve a good positioning accuracy of the workpiece manipulation device.

An embodiment, according to which it can be provided that a further manipulation device carrier is formed, which is arranged on the base rack so as to be displaceable by a further manipulation device carrier guide in a Y-axis relative to the base rack, wherein the further manipulation device carrier comprises multiple manipulation elements, which are arranged at a distance from one another in an X-axis, wherein the manipulation elements are displaceable in a Z-axis relative to the further manipulation device carrier, is also advantageous. This entails the advantage that, by means of the further manipulation device carrier, the workpiece to be bent can be positioned in a more flexible manner Here, it is particularly conceivable that the manipulation device carrier and the further manipulation device carrier cooperate to serve the positioning of the workpiece to be bent.

According to a further development, it is possible that a first guide rail and a second guide rail are arranged on the second limb of the manipulation device carrier, wherein the manipulation arm guide comprises a first guide carriage and a second guide carriage, which are guided in the first guide rail, and wherein the manipulation arm guide comprises a third guide carriage and a fourth guide carriage, which are guided in the second guide rail. Such a guide arrangement, in particular, entails the advantage that the workpiece can be positioned with a high degree of positioning accuracy. Furthermore, this measure can help achieve a sufficient clamping force being applied to the workpiece by means of the first rotary punch and the second rotary punch, wherein the deformation of the workpiece manipulation device, and with that, a possible source for positioning inaccuracy, can be kept to a minimum.

Moreover, it can be useful if a rotary motor for rotation the first rotary punch is formed on the manipulation device carrier. This measure allows changing the orientation of the workpiece. Due to the arrangement of the rotation motor on the manipulation device carrier and/or in cooperation with the first rotary punch, the inertia of the workpiece manipulation device can furthermore be kept to a minimum.

According to the invention, a processing system for bending workpieces is formed. Said processing system comprises:

- a swivel bending machine;
- a workpiece manipulation device for feeding workpieces to the swivel bending machine.

The workpiece manipulation device is formed according to one of the preceding claims.

The processing system according to the invention has the advantage that a high degree of positioning accuracy of the workpiece can be achieved.

It can be further provided that the manipulation arm has a clearance in the region of the first rotary punch, which clearance corresponds with the swivel bending machine. This entails the advantage that the first rotary punch can be moved as closely as possible to the swivel bending machine, which makes the processing of very small workpieces possible. Due to the clearance, the manipulation arm can have a sufficient stability in those regions which require it.

According to a particular embodiment, it is possible that the swivel bending machine has a lower machine table, wherein the base rack is coupled with the lower machine table at a first longitudinal end, and wherein, in a region distanced from the first longitudinal end, the base rack has a support foot for being supported on the floor. Particularly such a mounting of the workpiece manipulation device on the swivel bending machine entails a surprising positioning accuracy. In particular, this measure allows achieving that the bending operation of the swivel bending machine and, associated therewith, a force application and/or a deformation of the swivel bending machine, does not lead to an increase of the positioning inaccuracy of the workpiece.

For the purpose of better understanding of the invention, it will be elucidated in more detail by means of the figures below.

Figure 2:
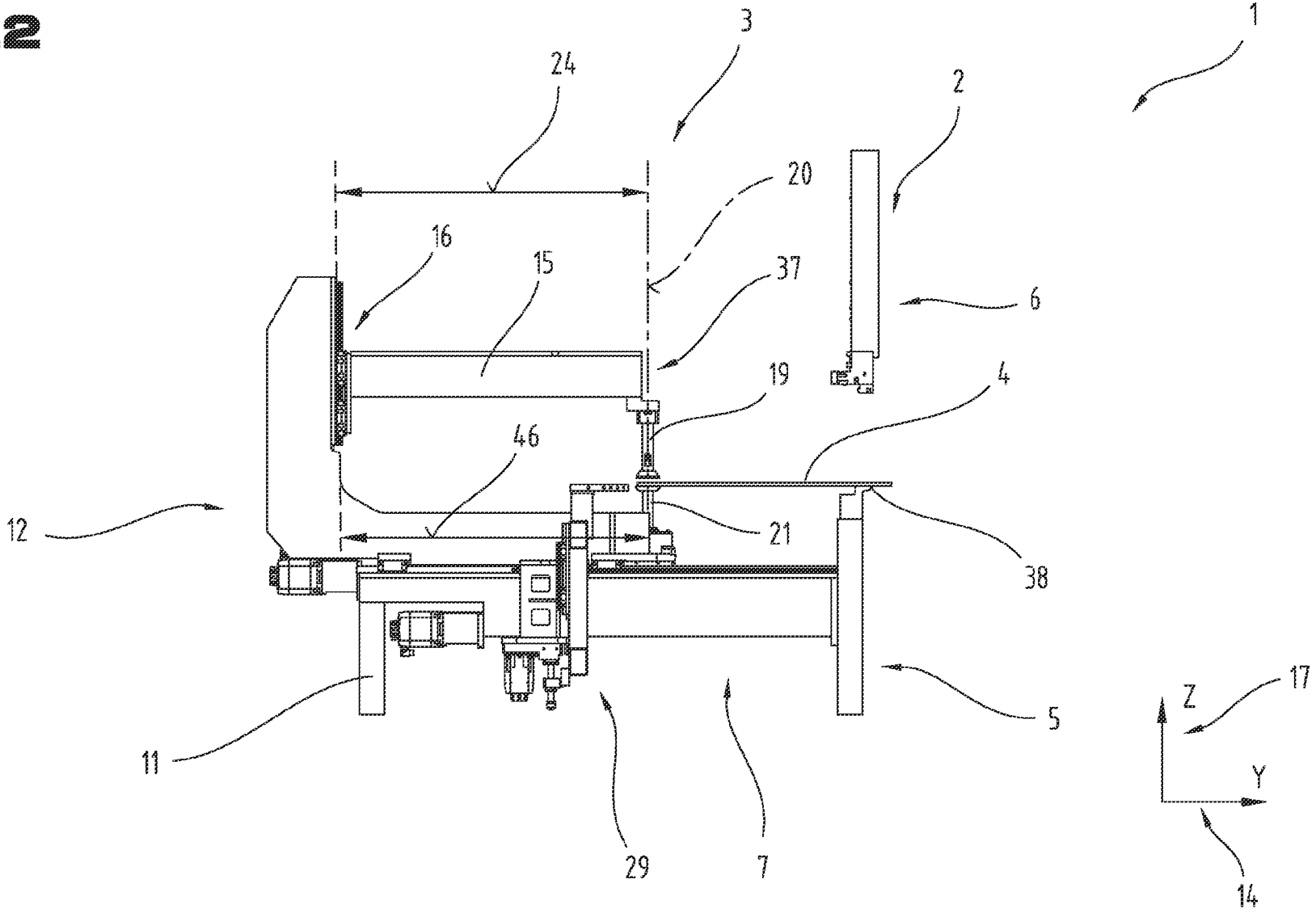
Figure 3:
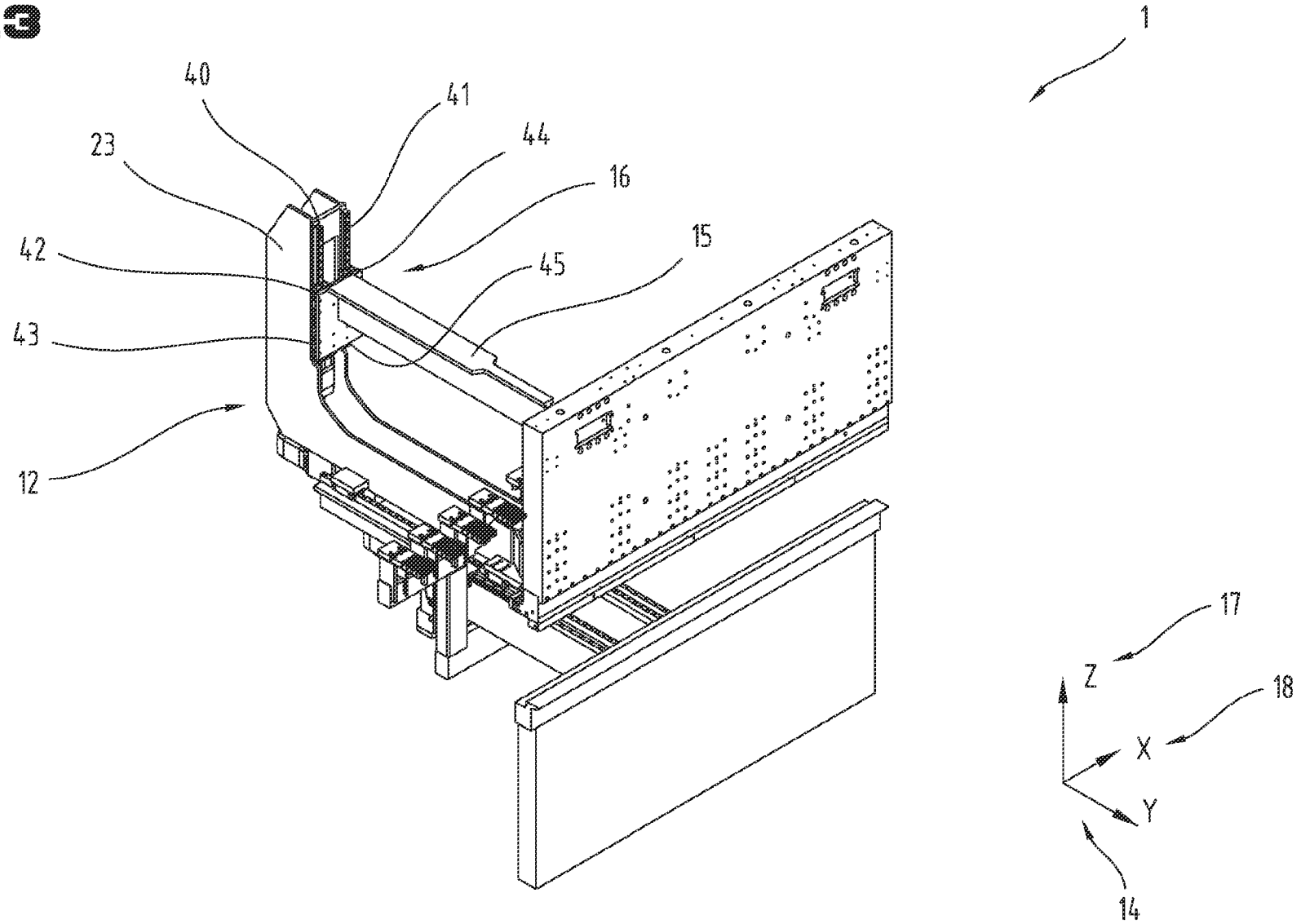

These show in a respectively very simplified schematic representation:

FIG. 1 a first exemplary embodiment of a processing system in a perspective view;

FIG. 2 the first exemplary embodiment of the processing system in a side view;

FIG. 3 the first exemplary by a processing system in a further perspective view.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

FIG. 1 shows a perspective representation of a first exemplary embodiment of a processing system 1. The processing system 1 can comprise a swivel bending machine 2. The processing system 1 can, moreover, comprise a workpiece manipulation device 3, which serves for manipulating a workpiece 4 to be processed.

For the purpose of clarity, the swivel bending machine 2 is only shown in a simplified manner in FIG. 1.

As evident from FIG. 1, the swivel bending machine 2 can comprise a lower machine table 5 and an upper machine table 6. Swivel bending tools can be clamped in the machine tables 5, 6, in particular in tool holders, which are formed in the machine tables.

The workpiece manipulation device 3 comprises a base rack 7. In the present exemplary embodiment, the base rack 7 is coupled with the lower machine table 5 at a first longitudinal end 8. In particular, it can be provided that a coupling flange 9 is formed, wherein the coupling flange 9 is coupled with the lower machine table 5 by means of fastening means 10 such as screws.

Furthermore, it can be provided that a support foot 11 is formed in a region of the base rack 7 distanced from the first longitudinal end 8, by means of which support foot 11 the base rack 7 can be supported on the ground, in particular on the hall floor.

Moreover, the workpiece manipulation device 3 can comprise a manipulation device carrier 12. The manipulation device carrier 12 can be arranged on the base rack 7 so as to be displaceable by means of a manipulation device carrier guide 13 in a Y-axis 14 relative to the base rack 7. Moreover, the workpiece manipulation device 3 can comprise a manipulation arm 15, the manipulation arm 15 can be arranged on the manipulation device carrier 12 so as to be displaceable by a manipulation arm guide 16 in a Z-axis 17 relative to the manipulation device carrier 12.

Moreover, it can be provided that an X-axis 18 is arranged at a right angle to the Z-axis 17 and to the Y-axis 14.

Furthermore, a first rotary punch 19 can be formed, which is arranged on the manipulation arm 15. The first rotary punch 19 can be arranged so as to be rotatable on the manipulation arm 15 about a rotational axis 20. The rotational axis 20 can be formed so as to lie in parallel to the Z-axis 17.

Furthermore, a second rotary punch 21 can be formed, which can be arranged on the manipulation arm 12. The second rotary punch 21 can also be arranged so as to be rotatable about the rotational axis 20.

The rotational axis 20 can be arranged at a distance 24 from the manipulation arm guide 16.

During operation of the workpiece manipulation device 3, the first rotary punch 19 and the second rotary punch 21 can cooperate such that a workpiece 4 can be clamped between the first rotary punch 19 and the second rotary punch 21. Due to a rotation movement of the two rotary punches 19, 21, the workpiece 4 clamped between said two rotary punches 19, 21 can be rotated and/or aligned. Furthermore, due to the displaceability of the manipulation device carrier 12 along the Y-axis, the workpiece 4 clamped between the rotary punches 19, 21 can be displaced along the Y-axis 14.

As is further evident from FIG. 1, it can be provided that the manipulation device carrier 12 has an L-shaped configuration. In particular, the manipulation device carrier 12 can have a first limb 22, which can extend along the Y-axis 14, and a second limb 23, which can extend along the Z-axis 17. In particular, it can be provided that the first limb 22 and the second limb 23 are arranged at a right angle relative to one another.

Furthermore, it can be provided that the manipulation device carrier 12 has a first cheek 25 and a second cheek 26. The first cheek 25 and the second cheek 26 can be configured identical in construction and each have an L-shape.

Furthermore, it can be provided that the first cheek 25 and the second cheek 26 are arranged at a distance 27 from one another. Furthermore, webs 28 can be formed between the first cheek 25 and the second cheek 26, by means of which webs 28 the first cheek 25 and the second cheek 26 are positioned and/or supported relative to one another.

Furthermore, it can be provided that a further manipulation device carrier 29 is formed, which is arranged on the base rack 7 so as to be displaceable by means of a second manipulation device carrier guide 30 in the Y-axis 14 relative to the base rack 7.

Manipulation elements 31 can be arranged on the further manipulation device carrier 29, which can serve for receiving the workpiece 4.

In particular, it can be provided that the manipulation elements 31 are configured to be electromagnetic, wherein the workpiece 4 can be electromagnetically fixed by means of the manipulation elements 31. In an alternative embodiment, it can be provided that the manipulation elements 31 have suction elements, wherein the workpiece 4 can be fixated by applying a vacuum on the manipulation elements 31.

In particular, it can be provided that the manipulation elements 31 are arranged below the workpiece 4 and the workpiece 4 lies flat on the manipulation elements 31.

As it can be further seen in FIG. 1, it can be provided that the manipulation device carrier guide 13 has at least one guide rail 32, in which at least one guide carriage 33 is guided. The guide rail 32 is arranged on the base rack 7. Furthermore, it is provided that the guide rail 32 extends in the direction of the Y-axis, so that the guide carriage 33 is arranged so as to be displaceable on the base rack 7 along the Y-axis 14. Furthermore, it can be provided that the guide carriage 33 is arranged on the manipulation device carrier 12. As is evident from FIG. 1, it can be provided that two of the guide rails 32 are arranged so as to be spaced apart from one another with respect to the X-axis 18. Analogously to this, multiple guide carriages 33 can be formed o the manipulation device carrier 12, which guide carriages 33 are also spaced apart from one another with respect to the Y-axis and/or with respect to the X-axis.

Furthermore, it can be provided that an adjustment drive 34 is formed, which serves for positioning the manipulation device carrier 12 along the Y-axis 14. The adjustment drive 34 can have a drive motor 35. The drive motor 35 can be coupled with, for example an adjusting spindle such as a ball screw. Furthermore, it is also conceivable that the further manipulation device carrier 29 is coupled with a further adjustment drive 36, by means of which it adjustable along the Y-axis 14.

FIG. 2 shows a side view of the first exemplary embodiment of the processing system 1, wherein again, equal reference numbers and/or component designations are used for equal parts as before in FIG. 1. In order to avoid unnecessary repetitions, it is pointed to/reference is made to the detailed description in FIG. 1 preceding it.

As is evident from FIG. 2, it can be provided that a clearance 37 is formed on the manipulation arm 15. The clearance 37 is configured such that it corresponds with the upper machine table 6 and/or with the tool clamped therein, so that the manipulation arm 15 can be moved as closely as possible to the upper machine table 6, in order to achieve the smallest possible distance between the rotational axis 20 and a bending edge 38. By this measure, the processing system 1 is capable of processing workpieces 4 that are as small as possible.

As is further evident from FIG. 2, it can be provided that a rotation motor 39 is formed, which serves for actively rotating the second rotary punch 21.

When actively rotating the second rotary punch 21, the workpiece 4 can be clamped between the first rotary punch 19 and the second rotary punch 21. In case of a rotation of the workpiece 4 clamped between the first rotary punch 19 and the second rotary punch 21, the first rotary punch 19 can also be rotated and/or dragged along due to a frictional connection to the workpiece 4. Due to the coaxial arrangement of the first rotary punch 19 and the second rotary punch 21, the joint rotation of the first rotary punch 19 and the second rotary punch 21 can be made possible. The first rotary punch 19 therefore does not need its own rotation motor for being rotated with respect to the rotational axis 20.

As it can be further seen in FIG. 2, the rotational axis 20 can be arranged at a distance 24 from the manipulation arm guide 16. Here, the center of the guide rail is considered as the relevant reference point of the manipulation arm guide 16.

As is further evident from FIG. 2, the manipulation device carrier 12 and the further manipulation device carrier 29 can be displaced along the Y-axis 14 individually and independently of one another. Thus, the rotary punches 19, 21 and/or the manipulation element 31 can move the workpiece 4 independently of one another. Moreover, this measure allows transferring the workpiece 4 between the rotary punches 19, 21 and the manipulation element 31. By this measure, the workpiece 4 can be rotated as desired in the processing system 1 and be positioned along the Y-axis 14 for performing a bending operation.

The first limb 22 of the manipulation device carrier 12 has a length 46. The length 46 of the first limb 22 of the manipulation device carrier 12 is measured starting from a side of the second limb 23 facing the swivel bending machine 2.

FIG. 3 shows the processing system 1 in a further perspective view, wherein again, equal reference numbers and/or component designations are used for equal parts as before in FIGS. 1 and 2. In order to avoid unnecessary repetitions, it is pointed to/reference is made to the detailed description in FIGS. 1 and 2 preceding it.

As it can be seen in FIG. 3, it can be provided that the manipulation arm guide 16 has a first guide rail 40 and a second guide rail 41. The first guide rail 40 and the second guide rail 41 are arranged on the second limb 23 of the manipulation device carrier 12. Furthermore, a first guide carriage 42 and a second guide carriage 43 are formed, which are guided in the first guide rail 40. The first guide carriage 42 and the second guide carriage 43 are arranged on the manipulation arm 15 so as to be spaced apart from one another in the direction of the Z-axis 17. Furthermore, it can be provided that a third guide carriage 44 and a fourth guide carriage 45 are formed, which are operatively connected to the second guide rail 41, and which are also coupled with the manipulation arm 15.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the technical teaching provided by the present invention lies within the ability of the person skilled in the art in this technical field.

The scope of protection is determined by the claims. Nevertheless, the description and drawings are to be used for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | Processing plant |
| 2 | Swivel bending machine |
| 3 | Workpiece manipulation device |
| 4 | Workpiece |
| 5 | Lower machine table |
| 6 | Upper machine table |
| 7 | Base frame |
| 8 | First longitudinal end |
| 9 | Coupling flange |
| 10 | Fastening means |
| 11 | Support foot |
| 12 | Manipulation device carrier |
| 13 | Manipulation device carrier guide |
| 14 | Y-axis |
| 15 | Manipulation arm |
| 16 | Manipulation arm guide |
| 17 | Z-axis |
| 18 | X-axis |
| 19 | First rotary punch |
| 20 | Axis of rotation |
| 21 | Second rotary punch |
| 22 | First limb |
| 23 | Second leg |
| 24 | Distance manipulation arm guide and rotational axis |
| 25 | First cheek |
| 26 | Second cheek |
| 27 | Distance first cheek - second cheek |
| 28 | Web |
| 29 | Further manipulation device carrier |
| 30 | Further manipulation device carrier guide |
| 31 | Manipulation element |
| 32 | Guide rail |
| 33 | Guide carriage |
| 34 | Adjustment drive |
| 35 | Drive motor |
| 36 | Further adjustment drive |
| 37 | Clearance |
| 38 | Bending edge |
| 39 | Rotation motor |
| 40 | First guide rail |
| 41 | Second guide rail |
| 42 | First guide carriage |
| 43 | Second guide carriage |
| 44 | Third guide carriage |
| 45 | Fourth guide carriage |
| 46 | Length of first limb |

The invention claimed is:

1. A workpiece manipulation device (3) for a swivel bending machine (2), wherein the workpiece manipulation device (3) comprises:

a base rack (7);

a manipulation device carrier (12), which is arranged on the base rack (7) so as to be displaceable by a manipulation device carrier guide (13) in a Y-axis (14) relative to said base rack (7);

a manipulation arm (15), which is arranged on the manipulation device carrier (12) so as to be displaceable by a manipulation arm guide (16) in a Z-axis (17) relative to the manipulation device carrier (12);

a first rotary punch (19), which is arranged on the manipulation arm (15), wherein the first rotary punch (19) is rotatable about a rotational axis (20) that is parallel to the Z-axis (17);

a second rotary punch (21), which is arranged on the manipulation device carrier (12), wherein the second rotary punch (21) is rotatable about the rotational axis (20), wherein the first rotary punch (19) and the second rotary stamp (21) are arranged relative to one another such that a workpiece (4) can be clamped between the first rotary punch (19) and the second rotary punch (21), wherein the manipulation device carrier (12) is configured in an L-shape and has a first limb (22), which extends along a Y-axis (14), and a second limb (23), which extends along the Z-axis (17), wherein the manipulation arm guide (16) is formed on the second limb (23), and wherein a distance (24) between the manipulation arm guide (16) and the rotational axis (20) of the first rotary punch (19) is greater than 1000 mm.

2. The workpiece manipulation device (3) according to claim 1, wherein the distance (24) between the manipulation arm guide (16) and the rotational axis (20) of the first rotary punch (19) is between 130% and 70% of a length (46) of the first limb (22) of the manipulation device carrier (12).

3. The workpiece manipulation device (3) according to claim 1, wherein the distance (24) between the manipulation arm guide (16) and the rotational axis (20) of the first rotary punch (19) is between 1000 mm and 3000 mm.

4. The workpiece manipulation device (3) according to claim 1, wherein the manipulation device carrier (12) has a first cheek (25) and a second cheek (26), which has an L-shaped configuration, wherein the first cheek (25) and the second cheek (26) are arranged at a distance (27) from one another and are coupled to one another by means of webs (28).

5. The workpiece manipulation device (3) according to claim 1, wherein a further manipulation device carrier (29) is formed, which is arranged on the base rack (7) so as to be displaceable by a further manipulation device carrier guide (30) in a Y-axis (14) relative to the base rack (7), wherein the further manipulation device carrier (29) comprises multiple manipulation elements (31), which are arranged at a distance from one another in an X-axis (18), wherein the manipulation elements (31) are displaceable in a Z-axis (17) relative to the further manipulation device carrier (29).

6. The workpiece manipulation device (3) according to claim 1, wherein a first guide rail (40) and a second guide rail (41) are arranged on the second limb (23) of the manipulation device carrier (12), wherein the manipulation arm guide (16) comprises a first guide carriage (42) and a second guide carriage (43), which are guided in the first guide rail (40), and wherein the manipulation arm guide (16) comprises a third guide carriage (44) and a fourth guide carriage (45), which are guided in the second guide rail (41).

7. The workpiece manipulation device (3) according to claim 1, wherein a rotation motor (39) for rotating the first rotary punch (19) is formed on the manipulation device carrier (12).

8. A processing system (1) for bending workpieces (4), wherein the processing system (1) comprises:

a swivel bending machine (2); and a workpiece manipulation device (3) for feeding workpieces (4) to the swivel bending machine (2), wherein the workpiece manipulation device (3) is formed according to claim 1.

9. The processing system (1) according to claim 8, wherein the manipulation arm (15) has a clearance (37) in the region of the first rotary punch (19), which clearance (37) corresponds with the swivel bending machine (2).

10. The processing system (1) according to claim 8, wherein the swivel bending machine (2) has a lower machine table (5), wherein the base rack (7) is coupled with the lower machine table (5) at a first longitudinal end (8), and wherein, in a region distanced from the first longitudinal end (8), the base rack (7) has a support foot (11) for being supported on the floor.

11. The workpiece manipulation device (3) according to claim 1, wherein the distance (24) between the manipulation arm guide (16) and the rotational axis (20) of the first rotary punch (19) is between 120% and 80% of a length (46) of the first limb (22) of the manipulation device carrier (12).

12. The workpiece manipulation device (3) according to claim 1, wherein the distance (24) between the manipulation arm guide (16) and the rotational axis (20) of the first rotary punch (19) is between 110% and 90% of a length (46) of the first limb (22) of the manipulation device carrier (12).

13. The workpiece manipulation device (3) according to claim 1, wherein the distance (24) between the manipulation arm guide (16) and the rotational axis (20) of the first rotary punch (19) is between 1100 mm and 2500 mm.

14. The workpiece manipulation device (3) according to claim 1, wherein the distance (24) between the manipulation arm guide (16) and the rotational axis (20) of the first rotary punch (19) is between 1300 mm and 2000 mm.

* * * * *